United States Patent [19]

Laakso et al.

[11] 4,177,105

[45] Dec. 4, 1979

[54] APPARATUS FOR DELIGNIFYING AND BLEACHING CELLULOSE PULP

[75] Inventors: Oliver A. Laakso; Michael I. Sherman, both of Glens Falls, N.Y.

[73] Assignee: Kamyr, Incorporated, Glens Falls, N.Y.

[21] Appl. No.: 695,559

[22] Filed: Jun. 11, 1976

Related U.S. Application Data

[63] Continuation of Ser. No. 362,924, May 22, 1973, abandoned.

[51] Int. Cl.[2] ..... D21C 7/12

[52] U.S. Cl. ..... 162/237; 162/44; 162/65; 162/248

[58] Field of Search ..... 162/65, 47, 41, 42, 162/43, 44, 46, 237, 248

[56] References Cited

U.S. PATENT DOCUMENTS

| | | | |
|---|---|---|---|
| 396,325 | 1/1889 | Brin | 162/65 |
| 1,457,326 | 6/1923 | Tompkins | 162/46 |
| 2,313,052 | 3/1943 | Dean | 162/47 X |
| 3,298,900 | 1/1967 | Laakso | 162/237 X |
| 3,441,475 | 4/1969 | Tomlinson | 162/237 |
| 3,654,070 | 4/1972 | Prodt et al. | 162/65 X |
| 3,660,225 | 5/1972 | Verreyne | 162/65 X |

OTHER PUBLICATIONS

Ogden, "Heat Recovery from Digester, Blowdown and . . . ", Tappi, vol. 121, No. 11 (Sep. 13, 1945), pp. 107–110; 162–47.

*Primary Examiner*—S. Leon Bashore
*Assistant Examiner*—Peter F. Kratz
*Attorney, Agent, or Firm*—Cushman, Darby & Cushman

[57] ABSTRACT

In an apparatus for treating cellulose pulp with oxygen gas by passing the pulp and oxygen gas through a reaction vessel at elevated temperature and pressure, the improvement whereby the exothermic heat of reaction is controlled and the temperature of the pulp being treated is maintained below the point where the pulp would be degraded, the improvement comprising means for withdrawing oxygen gas from the vessel after the gas has been in contact with the pulp, dividing the withdrawn gas into two portions, cooling one of the portions to remove water vapor therefrom, recombining the gas portions whereby the resulting gas has a lower temperature than the gas withdrawn from the vessel and returning the resulting gas to the vessel for further contact with pulp therein, the amount of gas withdrawn from the vessel and the degree of cooling of the cooled portion of withdrawn gas being regulated to maintain the temperature within the vessel below the point where the pulp is degraded.

1 Claim, 3 Drawing Figures

APPARATUS FOR DELIGNIFYING AND BLEACHING CELLULOSE PULP

Figures 1, 2, 3:
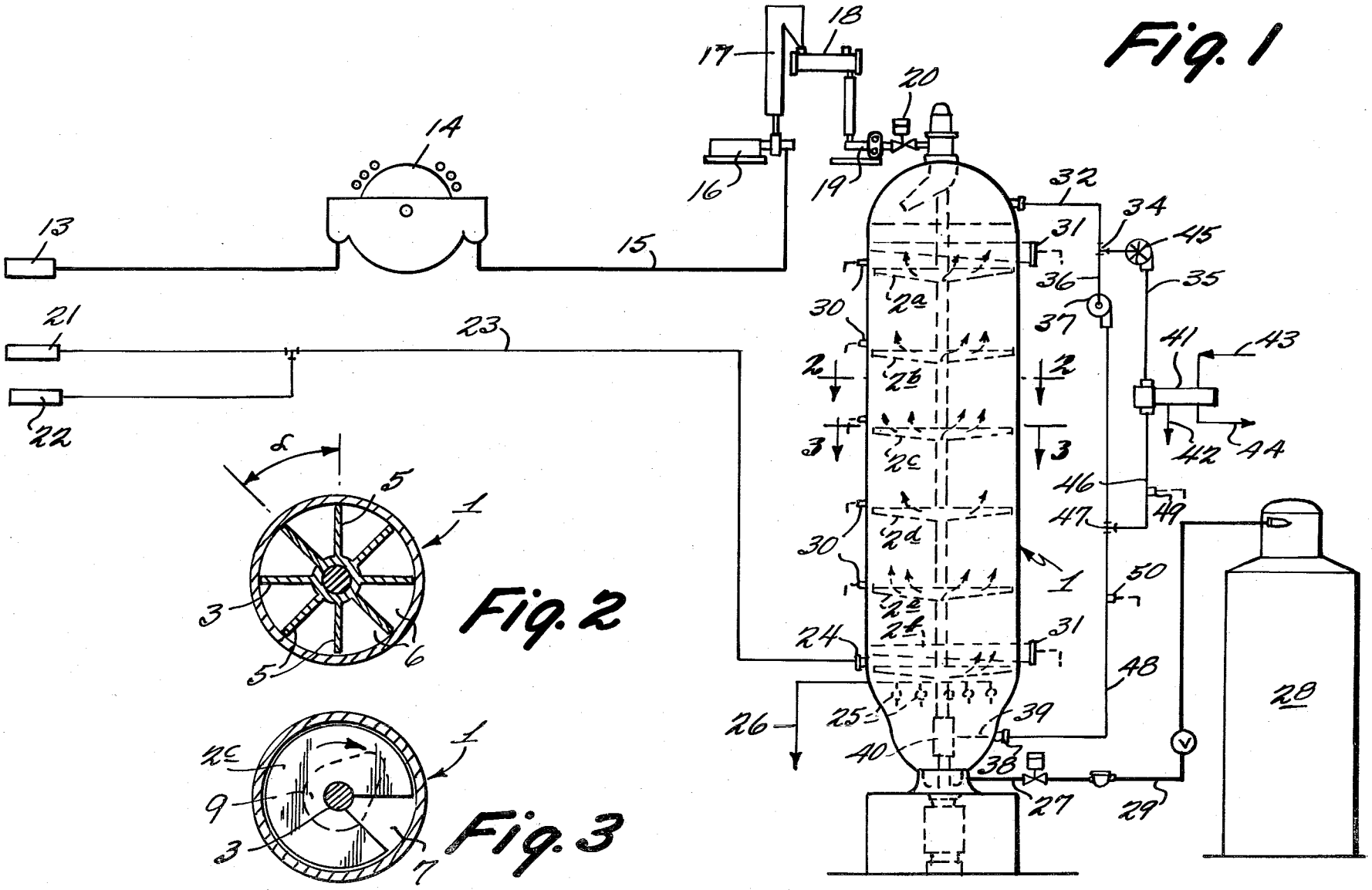

This is a continuation of application Ser. No. 362,924 filed May 22, 1973, now abandoned.

The present invention is concerned with the delignification and bleaching of cellulose pulp with oxygen gas under pressure.

It is recognized by the pulp and paper industry that the kraft process, which is heavily dependent on sulfur, may have to be modified in the near future to eliminate sulfur to avoid air pollution problems normally associated with kraft mills. In view of this, considerable research has been conducted in carrying out partial delignification with caustic while avoiding degradation of the cellulose and completing delignification and bleaching by using oxygen. Process and apparatus for the delignification and bleaching of cellulose pulp using oxygen are described in U.S. Pat. No. 3,660,225, the contents of which are incorporated herein by reference.

According to said U.S. Pat. No. 3,660,225, cellulose pulp is delignified and bleached with oxygen gas by dividing a stream of the pulp into a series of layers comprising discrete batches and progressively transferring the batches from layer to layer in controlled fashion so that the height of each layer does not exceed a maximum value at which the pulp at the bottom of a layer has a predetermined minimum gaseous content, the pulp being contacted with oxygen gas under pressure while progressively transferring pulp from one layer to the next in the series. The method may be carried out in an apparatus comprising a cylindrical pressure reaction vessel including axially spaced floors which define chambers between them, the chambers being subdivided into a plurality of compartments by dividing walls disposed axially to the pressure vessel and transversely to the floors, each floor having an aperture and the compartments and floors being relatively movable to allow pulp in the comprtments sequentially to be transferred from one chamber to the next as relative movement occurs.

The reaction between the pulp and the oxygen is an exothermic one and it has been found that, as the pulp proceeds through the reaction vessel, hot spots may occur where the temperature is excessively high, in terms of the time the pulp is exposed to such temperature, with the result that serious pulp degradation can occur. The temperature at which pulp degradation will occur depends on other factors, notably the time of exposure but, s an illustration, it has been noted that the temperature should not be significantly above about 240° F. if undesired degradation is to be avoided when the overall processing time is in the order of 15 minutes to 2 hours. Higher temperatures can be tolerated at shorter contact times but, in any event, care must be taken in carrying out the process of U.S. Pat. No. 3,660,225, to avoid temperature/time conditions which will cause pulp degradation.

The principal object of the present invention is to provide certain improvements in the method and apparatus of U.S. Pat. No. 3,660,225 which make it possible to control the reaction temperature within desirable limits and thus give a processed pulp of optimum properties. A more specific object is to provide a process and apparatus whereby the exothermic reaction which occurs using oxygen to delignify and bleach cellulose pulp is controlled so as to maintain an essentially uniform temperature in the reaction vessel without undesired hot spots which might cause pulp degradation. Other objects will also be hereinafter apparent.

Broadly stated, the invention is based on the feature of withdrawing a gaseous mixture of oxygen and water (in the form of water vapor or steam) from the top of the reaction vessel, dividing the withdrawn gas into two portions, cooling one of these portions of withdrawn gas to remove water therefrom by condensation, combining the cooled portion of gas with the other portion and distributing the combined portions of oxygen-containing gas in the vessel for further reaction with pulp therein, the amount and temperature of the gas as returned to said vessel being such as to maintain a substantially uniform temperature throughout said vessel below the degradation point of the pulp passing through th vessel. It will be recognized from what has been said above that the degradation temperature will depend on the reaction time but, under the time conditions outlined in U.S. Pat. No. 3,660,225, the temperature in the vessel should not generally exceed 240° F. and usually will be in the range of 210°–230° F. Higher temperatures, however, can be used without pulp degradation with shorter reaction times.

The invention is more fully described in connection with the accompanying drawings wherein:

FIG. 1 is a diagrammatic view of a pulp treating system including a reaction vessel according to U.S. Pat. No. 3,660,225 modified to include the temperature control modification of the invention; and FIGS. 2 and 3 are sectional views through the reaction vessel on the lines 2—2 and 3—3, respectively.

Referring more specifically to the drawings, FIG. 1 shows a reactor (1) which comprises a cylindrical pressure vessel which is provided with a plurality of vertically spaced pulp support decks *2a, 2b, 2c, 2d, 2e* and *2f* in the form of spaced discs, mounted on shaft 3 which is located co-axially within reaction vessel 1 and which is adapted to be rotatably driven by a motor (not shown). It will be recognized that the number of decks may be varied as desired so as to be more or less than the six shown.

A plurality of vertically extending, radially disposed dividing walls 5 (see FIG. 2) are located above each of the decks *2a, 2b, 2c, 2d, 2e* and *2f,* to divide the chamber above each deck into a plurality of upright compartments 6 disposed radially about shaft 3. The dividing walls 5 at the different levels are vertically aligned to provide corresponding compartments 6 at the different levels which are vertically aligned. The height of the dividing walls may be varied but is typically from 1–1.50 meters. Different or the same heights may be used for the various compartments.

As shown in FIG. 3, each deck is provided with an aperture 7 which may conform to the cross-sectional configuration of the compartments 6, the apertures of the various decks being angularly off-set preferably by an angle greater than a but usually less than *2a* where a corresponds to the angle subtended by one compartment 6 at the axis. The angle is so adjusted that all the pulp passing into the compartment is retained for the controlled residence period.

At its upper end, reaction vessel 1 is provided with a pulp inlet 8 and a rotary feeding device 9 which is mounted on shaft 3 and which is adapted to direct incoming pulp into the various compartments 6 above upper deck *2a.* Pulp to be bleached may be supplied to inlet 8 from a brown stock supply of digested pulp 13 via appropriate concentrating means 14, for example, a cylinder mold or the like, conduit means 15, one or more refiners 16, lift means 17, a steam mixer 18 and pump 19, the amount of pulp fed into inlet 8 being controlled by valve means 20. It will be recognized that various means and arrangements for supplying the pulp to vessel 1 can be used and the invention herein is not dependent on the specific system exemplified and described herein. Advantageously the pulp is fed to inlet 8 at about a 30% by weight solids content and a temperature of about 200°-210° F. The pulp in the brown stock supply is usually 10-14% solids and the desired degree of concentration is effected at 14 as shown.

Oxygen and high pressure steam are supplied from sources 21 and 22 through conduit means 23 into the bottom of the vessel through inlet 24. Usually the oxygen and steam are at a pressure of about 120-160 p.s.i.g. and have a temperature of about 210°-220° F. If desired the oxygen and/or steam may be supplied at other points in the vessel in lieu of or in addition to the bottom as shown.

At its bottom end, the reaction vessel (1) is also provided with nozzles 25 for diluting the treated pulp with water supplied through conduit means 26. Scraper means (not shown) may also be included in the bottom of the vessel to facilitate discharge of the processed pulp from pulp discharge 27, the discharged pulp being fed in conventional fashion to a blow tank 28 via a suitably valved conduit 29, then to washing means and/or other processing operations or storage as may be desired. Temperature recording means 30 may be provided along the length of the vessel, preferably adjacent each deck, to measure the temperature of the processed material. Additionally, appropriate level indicators 31 may be provided at suitable points along the height of the vessel, e.g. in the first and last compartments thereof, to determine pulp level and the passage of the pulp through the vessel.

In operation, pre-heated pulp (e.g. at 200° F., 30% solids) is fed into the top of the vessel via inlet 8 with a mixture of steam and oxygen at, for example, 200° F. and a pressure of 140 p.s.i.g. being fed into the bottom of the vessel through inlet 24. The oxygen and steam mixture introduced through inlet 24 passes upwardly through the vessel in countercurrent flow with the pulp to thereby bleach the pulp. Rotation of shaft 3 causes the various decks *2a, 2b, 2c, 2d, 2e* and *2f* to rotate so that the aperture 7 in each deck passes successively underneath the compartments 6 above such deck. It will be appreciated that as each deck rotates, a batch of pulp drops out of each successive compartment 6 above the deck into the corresponding compartment below the deck. Once the aperture 7 in the deck has passed a compartment 6 above the deck, the pulp in that compartment 6 above the deck remains substantially undisturbed until the aperture 7 reaches that compartment again during the next revolution of the deck. In this manner pulp is transferred compartment by compartment in stepwise fashion from the upper end of the pressure vessel 1 towards the bottom of the vessel from where treated pulp is discharged through outlet 27.

The speed of rotation of shaft 3 and therefore, of the decks, is dictated by the total height of the superimposed layers of pulp in reaction vessel 1 and the required reaction time. Reaction time can be widely varied depending on other operating conditions but, as an illustration, the pulp may be in the vessel undergoing treatment with the oxygen for a period of from about 20-90 minutes. Obviously, the reaction time can be varied by various means, e.g. by changing the speed of rotation of shaft 3.

As noted earlier herein, the bleaching reaction between the oxygen and the pulp as these materials pass countercurrently through the reaction vessel 1 is an exothermic one. Because of this, hot spots tend to occur, in the absence of the features of the present invention, where the temperature is such that degradation of the pulp occurs. The most likely location for such hot spots is in the pulp in the second or third compartments up from the bottom of the reaction vessel but hot spots can also occur elsewhere throughout the vessel. With contact times within the vesel in the order of 30-90 minutes and a gas pressure in the range of 120-150 p.s.i.g., usually about 130-140 p.s.i.g., best results are obtained if the temperature of the pulp within the vessel is in the range 210°-230° F. In any event, under the indicated conditions, particularly in respect of residence or contact time, the temperature should not generally significantly exceed 240° F. if undesired degradation of the pulp is to be avoided and a high quality product obtained.

The necessary temperature control, according to the invention, is realized by removing heat from gas in the system and redistributing the cooled gas to eliminate undesired hot spots and maintain a substantially uniform temperature throughout the vessel below the degradation temperature of the pulp. To this end, the invention provides the arrangement shown in FIG. 1 whereby the delignifying and bleaching gas constituting a mixture of oxygen and water vapor is withdrawn from the top of the reaction vessel through outlet conduit 32. At 34, conduit 33 is divided into two sections 35 and 36. Of these two sections, section 36 leads directly back to the bottom of the reaction vessel, gas passing through section 36 being fed by suitable blower means 37 or the equivalent through a return inlet 38 into the bottom of the vessel. In the embodiment shown, the return inlet feeds the gas into the vessel at the pressure prevailing therein through appropriate conduit means 39 diagrammatically shown in FIG. 1, and a suitably scaled stationary collar member inlet 40, which permits the shaft 3 to rotate therein. The shaft 3 and the decks *2a-2f* are hollow, the decks being provided with suitable orifices or apertures on their top surfaces as shown by the arrows in FIG. 1 so as to permit the oxygen gas which is returned via inlet 38 to go up the shaft 3 and out through the deck surfaces for distribution through, and reaction with, the pulp in each compartment. The apertures or orifices in the respective decks are advantageously changed in diameter to accommodate for pressure difference in the gas, i.e. there will be a pressure drop in the gas as it goes up the shaft 3 and, in the circumstances, the apertures in the decks may advantageously be gradually increased in going upwardly from one deck to the next higher deck. However, the purpose of distributing the cooled returned gas in the manner shown is to maintain an essentially uniform temperature throughout the vessel and it may be that other modifications in terms of the size and positioning of the deck apertures are desirable to avoid hot spots and insure an optimum temperature.

It will be recognized that other alternatives than the hollow shaft and decks may be used to feed and distribute the oxygen withdrawn from the top of the vessel through outlet 32 back into the vessel to maintain the desired temperature control. For example, a series of return conduits, each discharging into the vessel at a point just above the decks, may be used. However, the use of a hollow shaft and apertured decks as shown is preferred.

While section 36 leads part of the gas withdrawn from the top of the vessel directly back to the vessel, section 35 leads the rest of the gas mixture through appropriate cooling means 41. The gas mixture is suitably cooled in cooler 41 by the condensation of water vapor therefrom, the condensed water being discharged from the cooler at 42. The cooler may take any convenient form of condenser or heat exchanger, the desired cooling being effected, for example, by cooling water or other fluid supplied at 43 and discharged at 44. A blower 45 or the like may be included in section 35 just ahead of the cooling means to force the gas through the cooling means.

After being cooled, to the desired temperature, the gas (which is now essentially all oxygen, nearly all of the water vapor therein being removed by the cooling) is discharged from the cooler through conduit 46, the latter joining the gas which bypasses the cooler at 47. The resulting mixture is fed into the reaction vessel via conduit 48, inlet 38 and conduit 39 as described above.

Temperature recording means 49 and 50 are provided in conduits 46 and 48, respectively, to check the temperature of the gas from the cooler and the gas mixture below juncture 47 so that gas at the correct temperature can be fed back into the vessel 1. Valve means (not shown) are provided in the gas discharge conduit 32 and at the juncture 34 to regulate the total amount of gas withdrawn and the ratio of gas (a) passing through the cooler via conduit 35 and (b) bypassing the cooler via conduit 36. In this way, the amount of gas withdrawn and/or the ratio of the withdrawn gas which is cooled as against that which is not cooled can be regulated to give the temperature desired in the reaction vessel (as measured at 30) or in the gas return conduits as determined at 49 and 50. Thus, if the temperature is tending to rise undesirably in the reaction vessel, the amount of gas withdrawn at 32 can be increased and/or the amount of gas passing through the cooler 41 can be increased with respect to the amount of gas bypassing the cooler, so that the temperature of the gas being returned to the vessel at 38 is lowered to reduce the temperature in the reaction vessel.

As a typical example of operations according to the invention, cellulose pulp within vessel 1 is preferably maintained at about 210°-225° F. and a pressure of about 140 p.s.i.g. The pulp is admitted to the vessel via inlet 8 at about 30% solids and at a temperature about 200° F. A gaseous mixture (essentially oxygen and water vapor, usually at about a 10:1 volume ratio) with a temperature of about 230° F. is removed through conduit 32. Without this removal and subsequent cooling and redistribution of the removed gas, the temperature within the vessel would continue to rise locally or throughout the vessel above, for example, 240° F. and, with a residence time in the order of about 60 minutes, degradation of the pulp could occur as indicated earlier. However, with the invention, the conditions within the vessel can be brought to equilibrium, the gas withdrawn at 32 being divided into two portions, e.g. on a 5:1 volume basis (cubic feet per minute), one portion (the smaller) going through the cooler 41 so as to be cooled to about 120°-140° F. This condenses out essentially all of the water vapor in this portion of the withdrawn gas leaving substantially dry oxygen, the thus cooled, dry gas (at 120°-140° F.) being combined at 47 with the other portion of gas which bypasses the cooler to give a gas having a temperature of about 220° F. going back into the vessel at 38. The thus returned gas is redistributed through the shaft 3 and deck apertures into the pulp to maintain a uniform temperature of about 220° F. in the vessel.

Make up oxygen and steam are fed into the vessel at 24, preferably at a temperature of about 220° F. and at the pressure within the vessel.

Except as indicated, conditions used in the reaction vessel to bleach the pulp are as stated in U.S. Pat. No. 3,660,225.

It will be appreciated that the references herein to oxygen gas mean any gas containing free-oxygen, e.g. air. It will also be recognized that various modifications may be made in the invention as described above. Thus, the indicated ratio of gas removed from the reaction vessel which bypasses the cooler and which is cooled (5:1) can be widely varied, for example, it may be in the range of 3:1 to 10:1. Furthermore, different temperature conditions may be observed provided that the pulp temperature in the reaction vessel does not exceed the point where, at the residence time involved, cellulose degradation occurs in the pulp undergoing bleaching. Additionally, the manner in which the recycled gas is fed back into the reaction vessel can be varied as aforesaid or otherwise provided the variation is adequate to avoid hot spots and maintain an essentially uniform temperature in the vessel below the degradation point for the pulp being treated. Other variations and modifications are also contemplated as will be evident from the following claims wherein:

We claim:

1. An apparatus for treating cellulose pulp with oxygen gas in an exothermic reaction comprising a vertically elongated pressure vessel provided with a plurality of vertically spaced pulp support decks, means for supplying cellulose pulp into the uppermost of said decks, means for passing the thus supplied pulp downwardly and sequentially from one deck to another, means for supplying oxygen into the bottom of said vessel for passage upwardly through said vessel for contact with and treatment of the pulp at each deck, and means for supplying steam into the bottom of said vessel for passage upwardly through said vessel for contact with and treatment of the pulp at each deck, means for washing the treated pulp at the bottom of said vessel and means for discharging the washed pulp therefrom, and means for controlling the temperature of the pulp on the various decks throughout said vessel, said last-named means comprising means for withdrawing hot oxygen gas from the vessel after the gas has contacted pulp in said vessel, means for dividing the withdrawn gas into two separate portions, means for cooling one of these portions of withdrawn gas, means for combining the two portions after the one portion has been cooled, means for returning the combined portions to said vessel and means for distributing the thus returned gas into the vessel at a plurality of points therein adjacent different decks of said vessel so that the distribution of the cooled return gas is generally even and so that the formation of hot spots is prevented.

* * * * *